US005796680A

United States Patent [19]

Franklin

[11] Patent Number: 5,796,680

[45] Date of Patent: Aug. 18, 1998

[54] CHESS CLOCK

[76] Inventor: Lawrence R. Franklin, 11700 Amkin Dr., Clifton, Va. 20124

[21] Appl. No.: 834,943

[22] Filed: Apr. 7, 1997

[51] Int. Cl.[6] ..... G04F 3/00

[52] U.S. Cl. ..... 368/96

[58] Field of Search ..... 368/96, 97, 95

[56] References Cited

U.S. PATENT DOCUMENTS

| | | | |
|---|---|---|---|
| 3,395,287 | 7/1968 | Rajac | 250/221 |
| 3,961,473 | 6/1976 | Hung | 368/96 |
| 4,062,180 | 12/1977 | Meshi et al. | 368/96 |
| 4,079,583 | 3/1978 | Larsen | 368/96 |
| 4,382,291 | 5/1983 | Nakauchi | 368/96 |
| 4,472,067 | 9/1984 | Richardson et al. | 368/96 |
| 4,686,361 | 8/1987 | Bard | 250/96 |
| 4,884,255 | 11/1989 | Fischer | 368/96 |
| 5,420,830 | 5/1995 | Camaratta et al. | 368/96 |

*Primary Examiner*—Bernard Roskoski
*Attorney, Agent, or Firm*—Franklin Consultants

[57] ABSTRACT

A chess clock is disclosed in which clock pulses derived from a single source are switched alternately and mutually exclusively between two clocks, designated white's clock and black's clock. The mechanism for switching the clock pulses to and from each clock is operationally connected to their electronic circuitry by means of an optical beam, e.g., an infrared beam which is directed alternately to a pair of sensors connected respectively to control circuits for each clock. No mechanical or electrical operational connections are present between the switching mechanism and the electronic circuitry.

14 Claims, 4 Drawing Sheets

0:21.54
0:14.32
32
31
ON
OFF
2:00.00
40
HOURS
MOVES
MINUTES
TIME
CONTROL
FORWARD
SET
BACKWARD

POWER
200
ON/OFF SWITCH
38
228
INITIALIZER
A
B
204
100
WHITE SENSOR
OSCILLATOR
BLACK SENSOR
102
212
PULSE SHAPER
DIVIDERS
PULSE SHAPER
220
202
206
FLIP-FLOP
214
222
FLIP-FLOP
216
NOR
NOR
224
218
AND
AND
226
208
AND
AND
210
A
RED LIGHT/ BUZZER
40
B
26
WHITE CLOCK
OR
234
BLACK CLOCK
28
232
AND
SET
74
56, 58
TIME/MOVE DISPLAYS
TIME/MOVE SELECTOR
230
1ST/2ND TIME CONTR.
59
62
FORWARD, BACKWARD BUTTONS
HOURS, MINUTES, MOVES BUTTONS
60

CHESS CLOCK

BACKGROUND OF THE INVENTION

1. Field of the Invention

This invention relates to a chess clock for measuring the time controls allotted to the players in a chess game.

In competitive chess, players not only play against each other, they play against time as well. It is customary for each chess player to be required to make a certain number of moves, typically forty, in a specified length of time, usually two hours. If one of the players fails to make the required number of moves before his or her time runs out, that player loses the game, regardless of the situation on the board. In order to be able to impartially monitor the application and effects of these rules, chess clocks were invented.

At first, chess clocks were mechanical. Two clock faces, side by side in a single housing, each with its own spring-driven works and a pair of hands traversing a circular time scale, separately displayed the time remaining for each player. Two buttons extending through the top of the clock body and attached to opposite ends of a see-saw type rocker arm controlled the clocks. When one button was depressed, raising the other button, one clock was turned off and the other clock was turned on. Depression of the other button reversed the process, raising the first button while turning off the second clock and turning on the first clock. If the rocker arm was stopped, level, between both extremes, both clocks were turned off. This occurred either when the game was over or when play was suspended, such as to appeal a dispute to a tournament director, or, if a predetermined time has passed without a victor, the game is adjourned until a later date.

The drawbacks of mechanical clocks are obvious. Mechanical clocks are not known for their uniformity; one clock inevitably runs faster than the other, providing one player with an unfair, albeit an unintentional, advantage. Additionally, mechanical clocks are inaccurate to some degree, i.e., the time measured by the clock is different than the actual elapsed time. This is not so much of a problem if only one board is involved, and if both clocks are equally inaccurate, but in situations where multiple boards are in play, such as in tournament chess, it is unfair to give one board more time—or less!—than the remaining boards. It can easily be seen that it is critical that each player's playing time be accurately and fairly measured—accurate in that the measured amount of expired time is as close as possible to the actual elapsed time, and fair in that no player is given a different amount of time than any other.

2. Description of Related Art

The technology which produced digital, electronic watches in the late sixties was in time applied to chess clocks as well. See U.S. Pat. No. 3,961,473 to George Hung and U.S. Pat. No. 4,884,255 to former World Champion Robert J. (Bobby) Fischer, for example. They both have a single time source applied alternately to both displays, guaranteeing that at least both clocks will run at the same speed. At the same time, digital electronic timers are inherently more accurate than their mechanical counterparts. While the current batch of electronic chess clocks fulfill the functions needed by competitive players, two problems have plagued the industry:

(1) The switching mechanisms which alternately turn on and off each clock have not been sufficiently rugged to withstand the rigors imposed thereon by active chess players, who, especially when in time trouble or in blitz chess games, tend to pound on the clocks in an effort to turn off their own clock as quickly as possible; and (2) the electronic circuitry has been very complicated, providing many functions not necessary for the average competitive player, so the chess clock itself has become comparatively expensive—see U.S. Pat. No. 4,062,180 to Meshi et al, for instance.

The present invention addresses solutions to these problems.

OBJECTS AND SUMMARY OF THE INVENTION

The present invention overcomes the difficulties described above by providing a novel switching mechanism whose ruggedness is limited only by the materials used by the manufacturer and a digital chess clock with a novel straight-forward circuitry utilizing known digital components.

It is an object of the invention to provide a switching mechanism for alternately turning on and off each clock, a switching mechanism which is not operationally connected with the circuitry of each clock by either mechanical or electrical means, thereby allowing the switching mechanism portion of the chess clock to be as rugged as desired.

It is an object of the invention to provide circuitry for controlling which combines known, inexpensive logical units as subcombinations to effect the basic functions required by competitive chess players.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which:

FIG. 4 is a cross-sectional view of the switching mechanism with the right clock turned off and the left clock turned on;

DETAILED DESCRIPTION OF THE PREFERRED EMBODIMENT

Figures 1, 2:
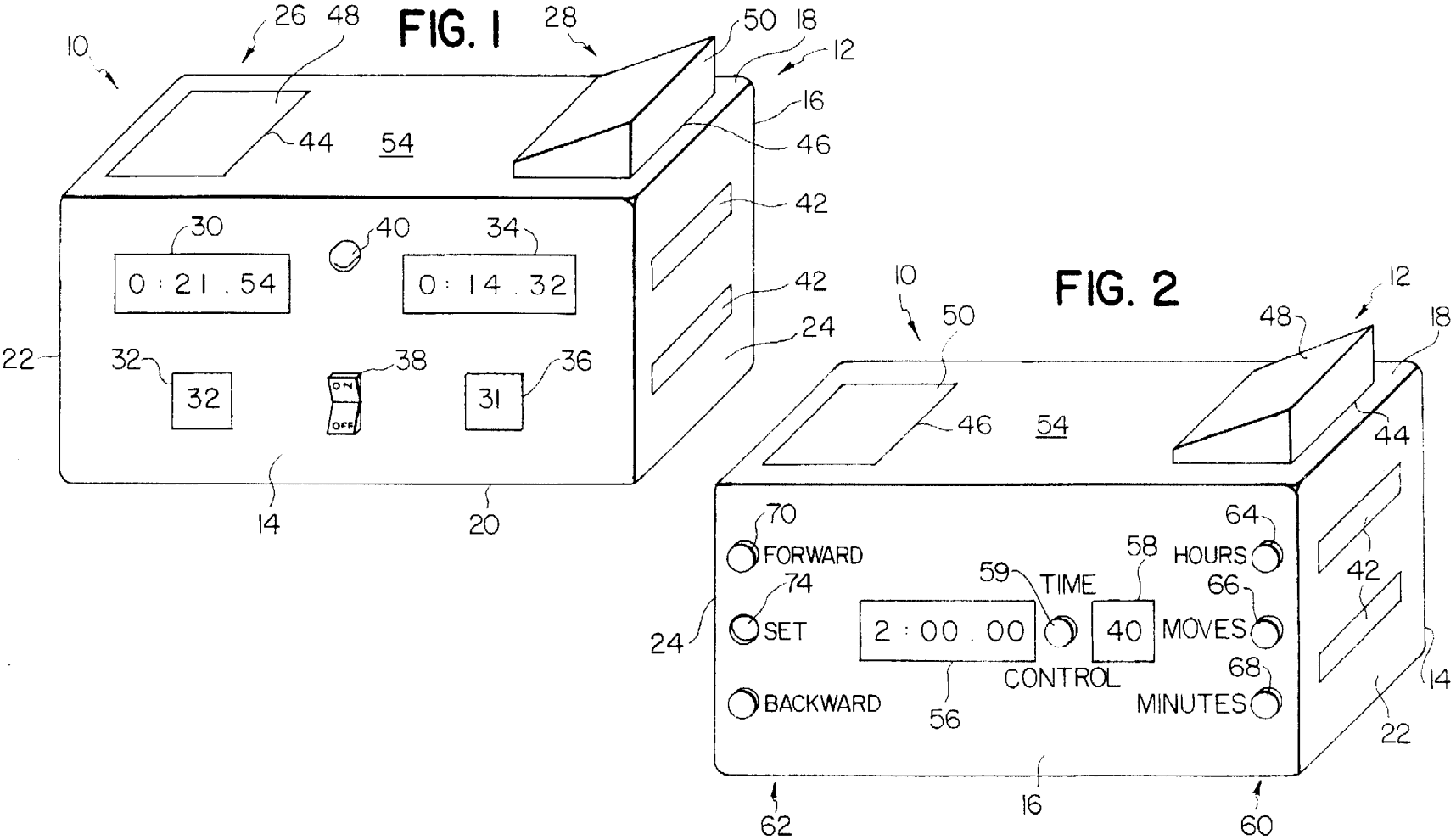
FIG. 1 is a perspective view of the front of the chess clock of the instant invention.
FIG. 2 is a perspective view of the back of the chess clock of the instant invention.

Referring to FIG. 1, chess clock 10 has a housing 12 comprising a front 14, back 16, top 18, bottom 20, and a pair of ends, left end 22 and right end 24. For descriptive purposes, the left half of the chess clock will be referred to as "white's" clock 26 and the right half of the chess clock will be referred to as "black's" clock 28, the players being referred to as white and black, respectively. This assignment of clock ends is identical to that when chess clock 10 is sitting beside a chess board to white's left, the position required by United States Chess Federation Tournament Rules.

White's clock 26 includes white's time display 30 and white's move display 32; black's clock 28 includes black's time display 34 and black's move display 36. The drawing shows white having made his or her thirty-second move and is awaiting black to do likewise. The displays can be any of the well known kind, so long as they are rugged enough to be reliable in use, e.g., liquid crystal displays (LCDs). An ON/OFF switch 38 and a red light 40 are also shown on front 14 of chess clock 10. Red light 40 indicates, when on or flashing, that time has expired for one of the players and the game is over, as will be explained in detail below.

Vents 42 on both ends 22 and 24 (see FIGS. 1 and 2) allow air to circulate within the housing and to permit egress of an audio signal, if included, to also announce the end of the game.

Figure 3:
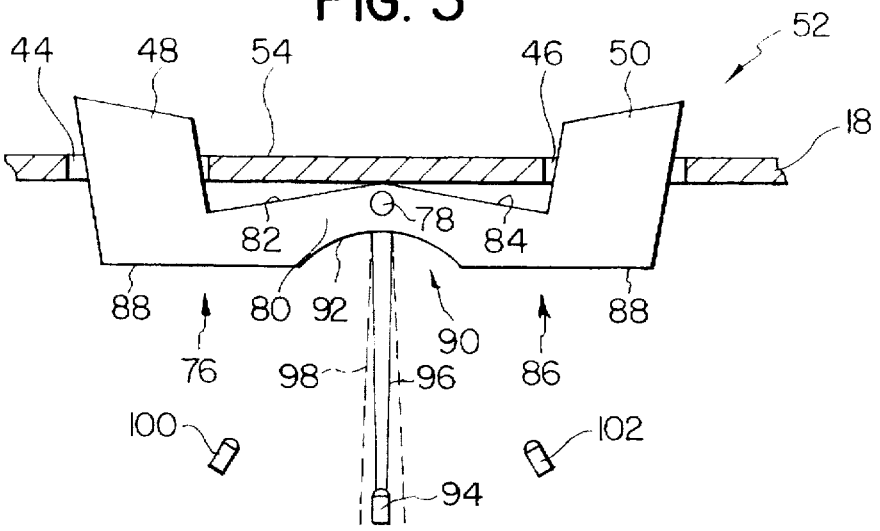
FIG. 3 is a cross-sectional view of the switching mechanism in its balanced, or neutral, position with both clocks turned off.
Figure 4:
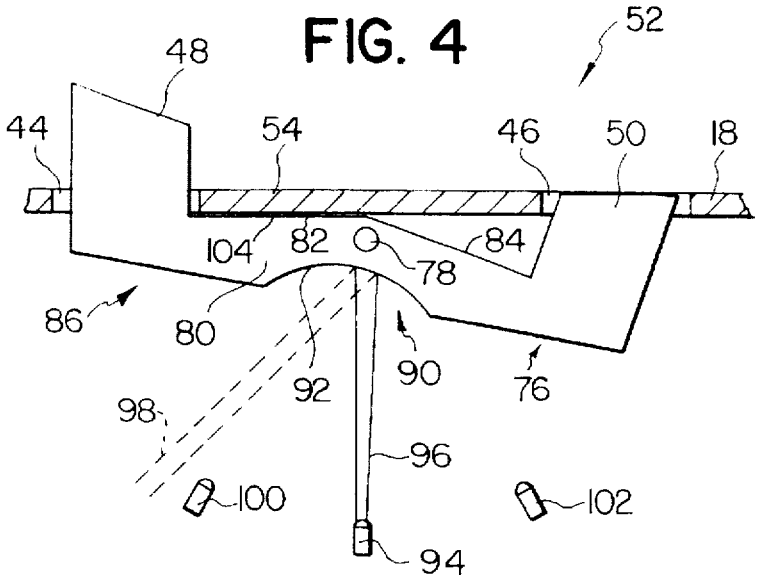
Figure 5:
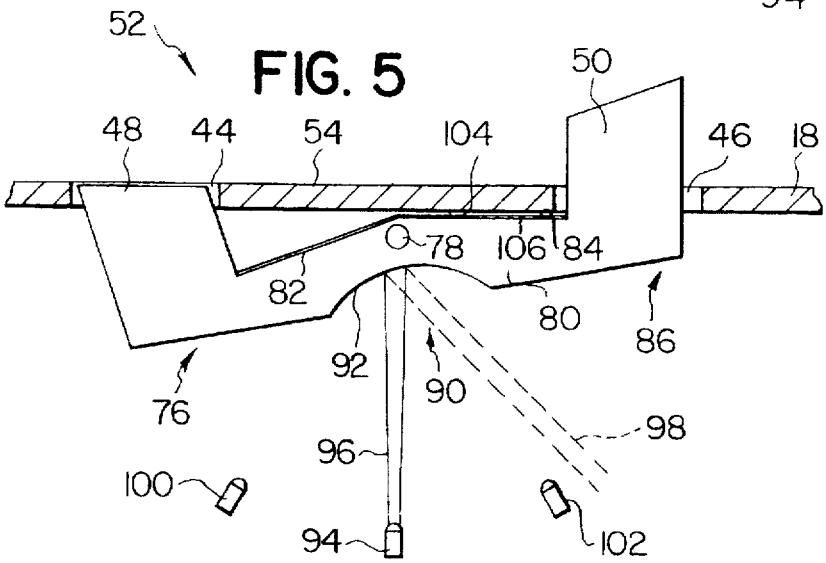
FIG. 5 is a cross-sectional view of the switching mechanism with the right clock turned on and the left clock turned off.

Top 18 includes two apertures 44 and 46 through which extend pedestals 48 and 50, respectively, of a switching mechanism 52 (see FIGS. 3–5). In FIG. 1, white's pedestal 48 is flush with top surface 54 of top 18, showing that white's clock 26 is off; black's pedestal 50 extends above top surface 54 of top 18, showing that black's clock 28 is on.

A perspective view of the back of chess clock 10 is shown in FIG. 2. In this view, chess clock 10 appears as if it has been rotated 180° from its FIG. 1 orientation while sitting on a table, thereby reversing the left-right positioning of white's/black's ends of chess clock 10. In FIG. 2, black's pedestal 50 is depressed flush with surface 54, indicating black's clock is off, and white's pedestal 48 is elevated above surface 54, indicating white's clock is on. A time selector display 56 and a move selector display 58 are located on back 16. These displays show one of the time controls, the time and move limits, respectively, imposed on both players. Between displays 56 and 58 is a recessed button 59 labelled "Time Control." Time control button 59 switches the internal selecting and displaying circuitry between a first time control and a second time control.

The term "time control" refers to the amount of time permitted to make a required number of moves. Although any time/move limits can be agreed upon (or required by a tournament director) as a time control, the most commonly used time/move limits for the first time control is two hours for forty moves. The first player to fail to make forty moves in the first two hours of his/her allotted playing time loses the game, even if he/she holds an overwhelming superiority in material or position. Once the requirements of the first time control has been met, a second time control takes effect. The most commonly used time/move limits for the second time control is one-half of the first time control, twenty moves in one hour. A time/move selector circuit in the internal electronic circuitry of chess clock 10 permanently stores these common time controls. When chess clock 10 is turned on by means of ON/OFF switch 38, two hours and forty moves will be displayed by default in time selector display 56 and move selector display 58, respectively.

Provision is made, however, for both time controls to be independently settable by means of selector buttons 60 at the right end of back 16 and control buttons 62 at the left end of back 16 to replace the permanently stored time controls for any particular game, when another time/move pair is required or agreed upon. Selector buttons 60 comprise an hours button 64, a minutes button 66, and a moves button 68. Control buttons 62 comprise forward button 70, backward (or reverse) button 72, and set button 74. In use, one of the players simultaneously depresses one of the selector buttons, such as hours button 64, and either forward button 70 or backward button 72 to scroll forward or backward through the hours digits 0–9. When the desired hour digit is displayed, release of either depressed button will stop the scrolling and display the selected number in time selector display 56. The minutes and moves are selected by a similar depression of minutes button 66 or moves button 68 simultaneously with forward button 70 or backward button 72. When the desired time and moves are displayed in time display 56 and move display 58, respectively, set button 74 is depressed to enter the time and moves displayed into the first time/move limit memories of both white's clock 26 and and black's clock 28. The circuitry to effect this is well known and is shown schematically in FIGS. 6 and 7, to be described later. Time control button 59 is then depressed to display the second time/move limits, and the second time/move limits are selected by means of selector buttons 60 and control buttons 62 as before.

Selector buttons 60 are arranged vertically at the right hand end of housing 12 convenient for depression by the right thumb. Control buttons 62 are arranged vertically at the left hand end of housing 12 convenient for depression by the left thumb. By requiring simultaneous depression of two widely separated buttons, accidental alteration of the time and move limits is minimized. Set button 74 is preferably recessed into back 16 to prevent accidental actuation thereof.

A side, cross-sectional view of the switching mechanism 52 is shown in each of FIGS. 3–5.

Referring to FIG. 3, rocker arm 76 is pivotally journalled on a pivot pin 78 for a see-saw type rocking motion thereabout. Pivot pin 78 is mounted to front and back walls 14 and 16 of housing 12. Rocker arm 76 is preferably a unitary structure shaped to include white's pedestal 48 and black's pedestal 50 integrally connected by a cross-piece 80. The view of rocker arm 76 in FIGS. 3–5 is a side view, showing the relative sizes of the cross-piece and pedestals. FIGS. 1–2 show the relative width of rocker arm 76, which as can be seen, is a substantial portion of the width of the clock. Rocker arm 76 is thus a relatively massive part of chess clock 10. The ruggedness of clock 10 is enhanced thereby. Pedestals 48 and 50 extend through apertures 44 and 46 in top 18, as aforenoted. The top surface of cross-piece 80 has a pair of surfaces 82 and 84 which slope symmetrically downwardly from a point immediately above pivot pin 78; the angle between surfaces 82 and 84 is selected, along with the height of pedestals 48 and 50, such that the pedestal of the clock which is off is flush with top surface 54 of top 18 and such that the amount the on pedestal projects above top surface 54 is sufficient to unequivocally show whose clock is on. When both pedestals are seen protruding above top surface 54, as in FIG. 3, both clocks are clearly indicated as off.

The bottom 86 of cross-piece 80 is shaped to include a pair of symmetrically oriented flat portions 88 separated by an arcuate recess 90. Recess 90 is centered on pivot pin 78. The surface 92 of recess 90, seen in edge view in FIGS. 3–5, extends across the width of rocker arm 76 and is mirrored to be highly reflective. Spaced from rocker arm 76 directly below pivot pin 78 is an infrared emitter 94 which, when ON/OFF switch 38 is turned to the ON position, emits a narrow infrared radiant beam 96, the boundaries of which are shown throughout the drawings as solid lines. Since emitter 94 is fixed in housing 12, radiant beam 96 is always directed straight upwardly toward mirrored surface 92; see FIGS. 4–5. Radiant beam 96 is reflected from mirrored surface 92 as a reflected beam 98, the boundaries of which are shown throughout the drawings as dashed lines. The direction of reflected beam 98 is dependent upon the angle of rotation of rocker arm 76. In the position shown in FIG.

3, reflected beam 98 is directed substantially straight back toward emitter 94. Spaced a sufficient distance from emitter 94 to avoid accidental exposure to reflected beam 98 are a pair of infrared sensors 100 and 102. A baffle structure, not shown, used to isolate infrared sensors 100 and 102 from radiant beam 96 and reflected beam 98, is also within the purview of the invention. Sensor 100 is the input sensor to white's clock 26, and sensor 102 is the input sensor to black's clock 28, as will be discussed in detail with reference to FIG. 6. The orientation of rocker arm 76 as shown in FIG. 3 is its neutral position in which both clocks are turned off. This is the position of rocker arm 76 at the beginning of the game and anytime play has been suspended.

As the game begins, the player playing the black pieces depresses pedestal 50 until it stops flush with top surface 54 of top 18, ending in the position shown in FIG. 4. The clockwise rotation of rocker arm 76 caused by black's depression of pedestal 50 stops when sloping surface 82 of the top of cross-piece 80 comes into contact with the bottom surface 104 of top 18. Depressing pedestal 50 turns on white's clock to start the countdown of white's allotted time, as will now be explained.

Rotation of rocker arm 76 also rotates mirrored surface 92. As rocker arm 76 is rotated from the FIG. 3 orientation to that shown in FIG. 4, the changing angle of mirrored surface 92 causes reflected beam 98 to sweep angularly, clockwise, from the right of sensor 100, over sensor 100, to the position shown beyond sensor 100. As reflected beam 98 impinges upon sensor 100, sensor 100 responds by generating an electrical pulse which turns on white's clock by means of the circuitry shown in FIG. 6.

After white makes a move, he or she immediately depresses white's pedestal 48 until it stops flush with top surface 54 of top 18, as shown in FIG. 5. In this position, top surface 84 of cross-piece 80 is in contact with bottom surface 104 of top 18. Preferably, surfaces 82 and 84 are covered with some sort of cushioning means 106 (shown as a heavier black line in FIG. 5) to soften the impact thereof with surface 104; alternatively, cushioning means may be affixed to bottom surface 104. (As an option, cross-bars (not shown), which may be cushioned or have adjustable stops provided thereon, may be fixed to front 14 and back 16 beneath surfaces 88 as stops for rocker arm 76.) All stops are located to ensure that the top of whichever pedestal is depressed will be flush with top surface 54. Other than this, the location of the stops is not critical to the operation of the switching mechanism. Switching is effected by reflected beam 98 passing sensors 100 and 102. Since reflected beam 98 will have already passed the sensor involved long before rocker arm 76 needs to be stopped, the exact location where it is stopped has no affect on the functional operations of switching mechanism 52. During the rotation of rocker arm 76, reflected beam 98 swings back in the opposite direction, counter-clockwise in FIG. 5, recrossing white's sensor 100, thereby generating another pulse which turns off white's clock, and crosses black's sensor 102, generating a pulse which turns on black's clock.

Black depresses pedestal 50, when he or she makes a move, returning the switching mechanism to the orientation shown in FIG. 4.

In the process, as is apparent from the drawings, reflected beam 98 will have swung back in the opposite direction, recrossing black's sensor 102, turning off black's clock, and again crossing white's sensor 100, turning white's clock back on. Thus, each oscillation of rocker arm 76 between the two extreme positions shown in FIGS. 4 and 5, sequentially turns off the clock which was on and turns on the clock which was off. If rocker arm 76 is stopped in the centered position, as shown in FIG. 3, the clock which was on has been turned off, but the clock which was off has not yet been turned on. Although both clocks 26 and 28 are off, chess clock 10 is still on and the time and move displays continue to show the current time remaining for each player and the number of moves already made by each player. Play has been suspended, but it can be resumed at any time simply by depressing the appropriate pedestal.

Mirrored surface 92 is shown as arcuate for descriptive purposes only. It could be flat and still perform the required function of reflecting radiant beam 96 such that reflected beam 98 sweeps from side to side, sequentially across both sensors 100 and 102. The actual shape of surface 92 will be selected to configure reflected beam 98 so as to achieve reliable, effective responsiveness of the electronic circuitry to the movements of rocker arm 76.

Figure 6:
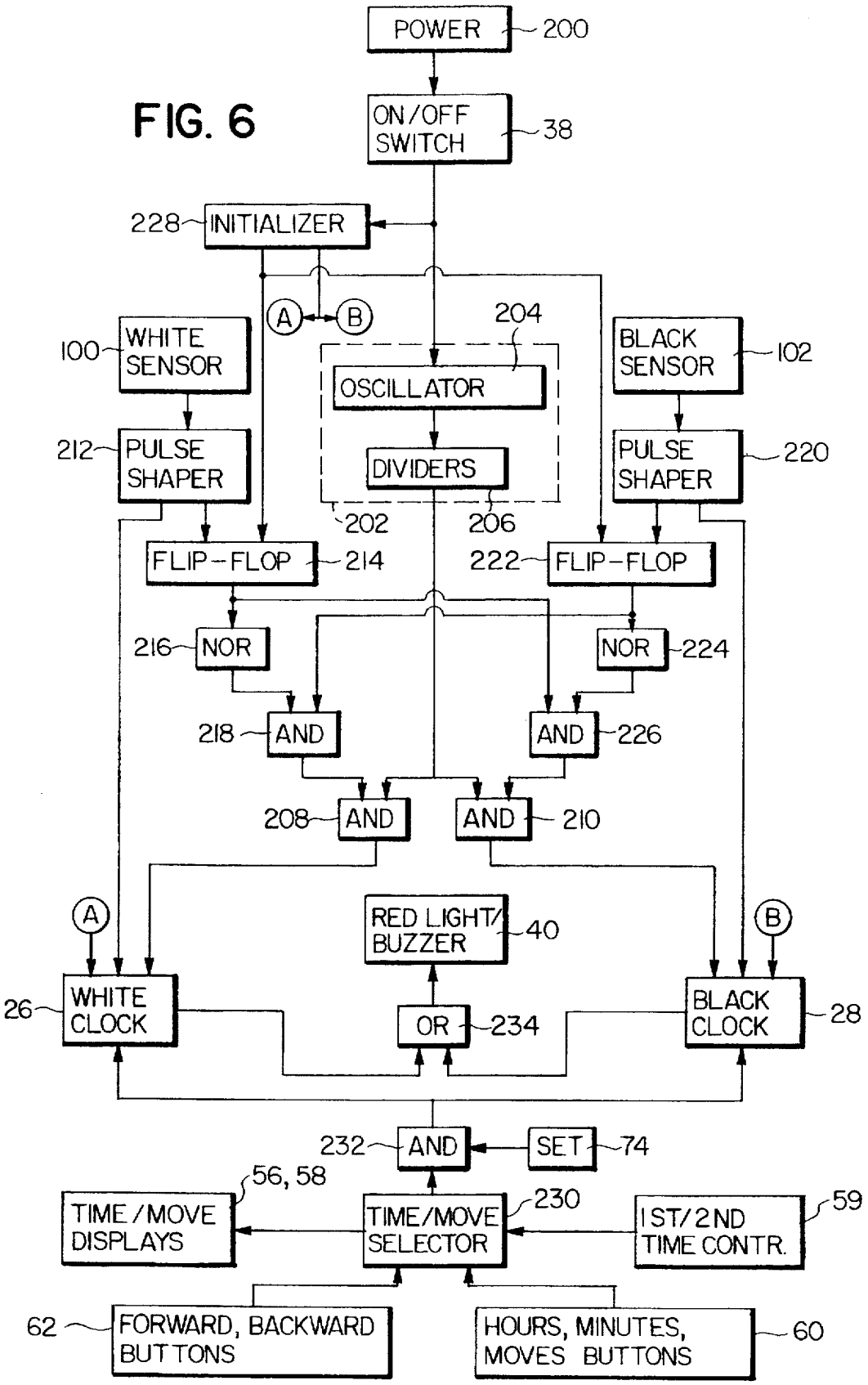
FIG. 6 is a block diagram of the circuitry of the chess clock of the instant invention.
Figure 7:
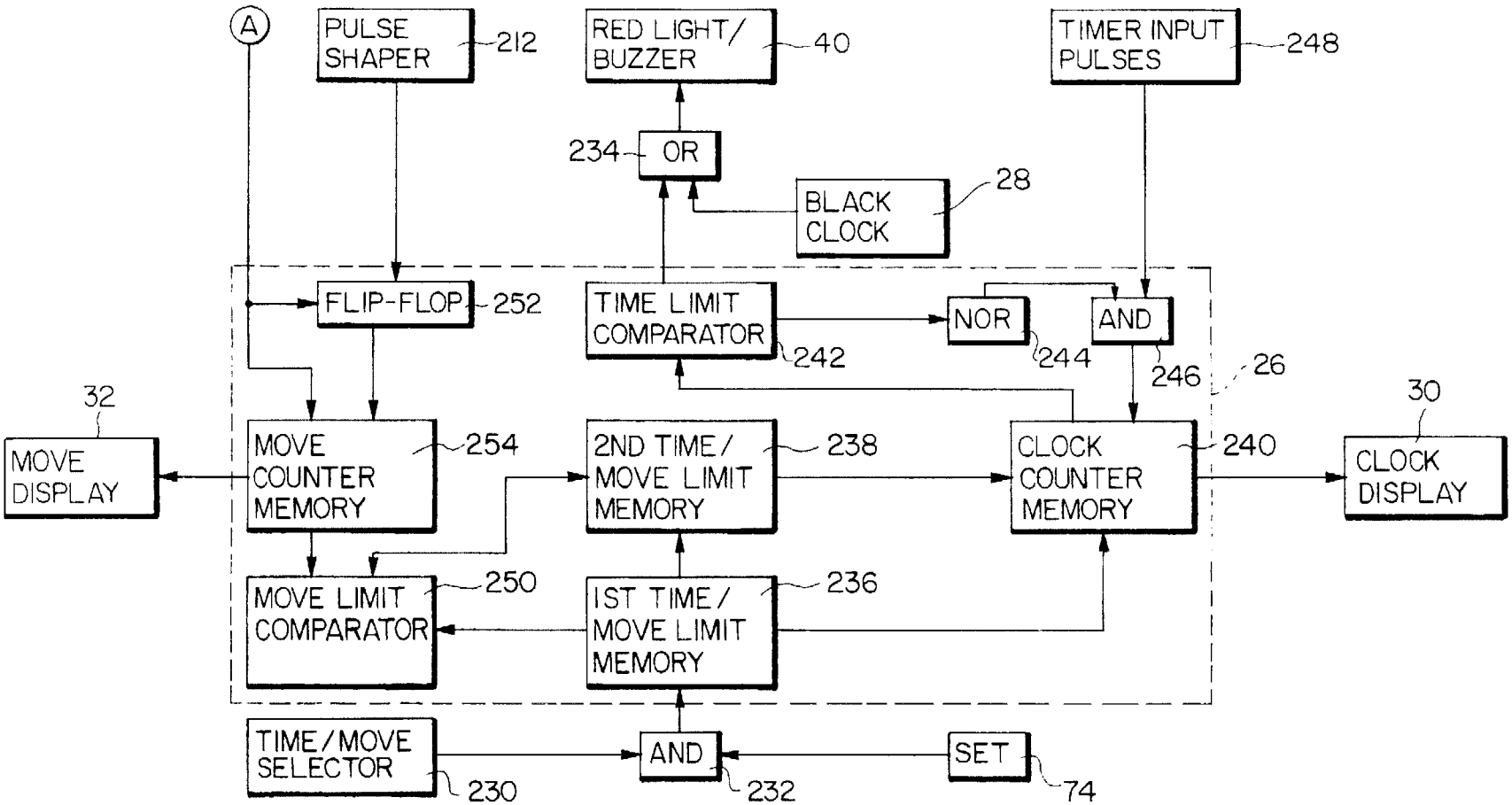
FIG. 7 is a block diagram of the circuitry of one of the clocks in the chess clock.

Turning now to the electronics of chess clock 10 as shown in block diagram form in FIGS. 6 and 7, wherein FIG. 6 shows the overall circuitry and FIG. 7 shows the circuitry of one of the player's clocks.

Referring to FIG. 6, a power source 200 is provided, which can be a battery or batteries, an AC adapter, or a combination of both, as is well known in the art. ON/OFF switch 38 connects power source 200 to all of the electrical components of chess clock 10. Electrical connections solely for the purpose of supplying power to elements of the circuitry have not been shown, since they are rudimentary in the art, and their presence would unduly, unnecessarily complicate the drawings.

ON/OFF switch 38 connects power source 200 with a standard timing pulse generator 202 comprising an oscillator 204 and dividers 206 which reduce the number of output pulses to a usable number, as is well known in the art. The output pulses of pulse generator 202 are applied to timing AND gates 208 and 210 and, ultimately, therethrough to white's clock 26 and black's clock 28, respectively. (All AND gates used herein provide a logical ONE output only when both inputs are logical ONEs. If either or both inputs are ZERO, the AND gate's output will be ZERO, also.)

The circuitry for alternately and mutually exclusively activating each clock will be initiallly described in terms of the logical units associated with white's clock 26.

White's sensor 100 generates a logical ONE pulse in response to reflected beam 98 sweeping thereover. Inasmuch as the characteristics of the pulses from sensor 100 will inevitably vary depending on how fast reflected beam 98 crosses sensor 100, some pulses may not be suitable for use as an input to the remaining circuitry. To compensate therefor, pulse shaper 212 is provided to shape the sharpness, amplitude, and duration of the pulse into a usable form. Pulse shaper 212 provides two simultaneous output pulses, always logical ONEs, in response to each input pulse from sensor 100. One of the output pulses of pulse shaper 212 is sent to white's clock 26 as a move counting input pulse, as will be described more fully later; it is shown in FIG. 7 as a circle-PS. The other output pulse from pulse shaper 212 is directed to a flip-flop 214 which alternately changes state between a logical ONE and a logical ZERO in response to each input pulse. NOR unit 216 changes the logical state of the signal received from flip-flop 214 to the opposite state and feeds it into steering AND gate 218. The output of steering AND gate 218 is one of the inputs of timing AND gate 208. Since the other input to timing AND gate 208 carries the timing pulses from pulse generator 202, steering AND gate 218 essentially acts to open or close timing AND gate 208, to pass or to block the timing pulses, and thus to steer the timing pulses to or from white's clock 26.

Black's clock is associated with similar logical units, namely, a sensor 102, a pulse shaper 220, flip-flop 222, NOR unit 224, and steering AND gate 226, all functioning in the same manner as the corresponding units in the circuitry associated with white's clock 26.

The two circuits are interconnected by feeding the output of white's flip-flop 214 to black's steering AND gate 226 and by feeding the output of black's flip-flop 222 to white's steering AND gate 218. These signals lock out the circuitry associated with the other clock to ensure disablement of the steering AND gate for the clock turned off.

When ON/OFF switch 38 is first turned on, power is also connected to an initializer circuit 228, preferably a one-shot multivibrator which provides a single output pulse when ON/OFF switch 38 is turned on and then lies dormant until chess clock 10 is turned off. The said single pulse is directed separately (1) to white's flip-flop 214 and to black's flip-flop 222 to set the logical state of both to ONE, thereby initially turning both clocks off, and (2) to the move counting circuit of both clocks (over lines designated circle-A for white's clock 26 and circle-B for black's clock 28) where it zeros the counting circuits preparatory for counting.

The operation of the circuitry thus provided will now be described.

Prior to turning on chess clock 10, rocker arm 76 must be leveled, in the FIG. 3 orientation. Then ON/OFF switch 38 is turned ON, and initializer circuit 228 sets both white's flip-flop 214 and black's flip-flop 222 to ONE. NOR unit 216 and NOR unit 224 both change that signal to ZERO which disables steering AND gates 218 and 226. With steering AND gates 218 and 226 both set at ZERO, timing AND gates 208 and 210 are both closed, blocking the timing pulses from pulse generator 202 from reaching either clock. This is the situation shown in FIG. 3 with rocker arm 76 balanced. Both clocks are turned off. Simultaneously, initializer circuit 228 sets the counting circuits of both clocks to zero. The time controls are entered into clocks 26 and 28, and the game is ready to begin.

When black starts the game by depressing pedestal 50 (FIG. 4), reflected beam 98 sweeps over white's sensor 100 generating a pulse. Pulse shaper 212 shapes the pulse and sends it to flip-flop 214, changing the output of flip-flop 214 from its initialized state of ONE to ZERO. NOR unit 216 changes the signal back to ONE and applies it as an input to steering AND gate 218. Since Black's flip-flop 222 is still in its initialized state of ONE, both of the inputs of white's steering AND gate 218 are ONEs, and its ONE output opens white's timing AND gate 208. Timing pulses from pulse generator 202 are allowed to pass through timing AND gate 208 to white's clock 26. White's clock 26 has been turned on.

Black's steering AND gate 226 is still disabled due to both inputs thereto being ZERO. Not only does black's NOR unit 224 inhibit black's steering AND gate 226, but the ZERO from white's flip-flop 214 also locks black's steering AND gate 226 in its disabled state, guaranteeing black's timing AND gate 210 is disabled, also. Black's clock 28 remains off.

As will be described subsequently, the time limit set in white's clock memory counter will start to count down toward zero, and will continue to count down until white turns off his or her clock by depressing pedestal 48 (FIG. 5).

When white depresses pedestal 48, reflected beam 98 recrosses white's sensor 100, turning off white's clock 26 by the following sequence of events:

Pulse shaper 212 changes flip-flop 214 to ONE which unlocks black's steering AND gate 226; black's steering AND gate 226 (and thereby black's timing AND gate 210) is still off, however, due to NOR unit 224 still being off. Black's clock 28 remains off. Simultaneously, the ONE from white's flip-flop 214 is changed by NOR unit 216 to ZERO, disabling white's steering AND gate 218 which closes white's timing AND gate 208. White's clock has been shut off. The ONE pulse from pulse shaper 212 which is fed directly to the move count input of white's clock 26 activates the circuit which increments white's move counter display 32 by one move, as will be described relative to FIG. 7.

When reflected beam 98 sweeps over black's sensor 102, a pulse is generated which black's pulse shaper 220 shapes and inputs to black's flip-flop 222 changing its output from its initialized ONE to a logical ZERO, which locks closed white's steering AND gate 218 and therethrough white's timing AND gate 208. NOR unit 224 changes the signal from black's flip-flop 222 back to a ONE and applies it as an input to steering AND gate 226. Since both of the inputs of black's steering AND gate 226 are now ONEs, AND gate 226 outputs a ONE which opens black's timing AND gate 210, and timing pulses from pulse generator 202 are allowed to reach black's clock 28 to count down black's clock memory counter toward zero. Black's clock 26 has been turned on.

When black depresses pedestal 50 after making a move, reflected beam 98 first traverses black's sensor 102 which generates a pulse, shaped by pulse shaper 220, switching flip-flop 222 which disables steering AND gate 226, ultimately closing timing AND gate 210 and shutting off black's clock 28. The other output pulse from pulse shaper 220 is input directly to the move count input of black's clock 28 and activates the circuit which increments black's move counter display 36 by one move. This returns switching mechanism 52 to the state shown in FIG. 3, and the sequence repeats as before described as reflected beam traverses white's sensor 100, again.

Thus, when rocker arm 76 is rotated such that reflected beam 98 passes a sensor for the first time, i.e., on the upswing in the drawings, the clock associated with that sensor turns on; when reflected beam 98 passes the same sensor a second time, on the downswing, the clock associated with that sensor turns off. Each clock is turned on and off independently of the other clock. Of course, when a player depresses his or her pedestal completely, rocker arm 76 swings from one extreme orientation to the other, i.e., from FIG. 4 to FIG. 5 or vice versa, without stopping in the FIG. 3, balanced position, unless the player deliberately pauses at that point. This pause between actuation of each individual clock allows, in a simple, inherent way, the suspension of the game where neither clock is counting down.

It can be seen that the sole operational contact of switching mechanism 52 with the electronics of chess clock 10 is optical, via the infrared beam emitted by emitter 94. There are no mechanical or electrical operational connections between rocker arm 76 and the electronics of clock 10. That is, the operational function of switching the timing pulses from one player's clock to the other player's clock is not effected by either mechanical or electrical connections, both of which commonly fail under the vibrational stresses imposed thereon by players pounding heavily on switching mechanisms. Even in clocks which have always been treated gently, electrical and mechanical connections eventually break or wear out. This is not the case with the disclosed invention, where the sole operational connection between switching mechanism 52 and the electronics of clock 10 is via an optical beam. This is an important feature of the inventive chess clock, for it allows rocker arm 76 and housing 12, the only parts of chess clock 10 which are actually, physically subject to violent beatings by active chess players, to be constructed as ruggedly as economically feasible, allowing chess clock 10 to withstand the abuse typically inflicted thereon without transmitting damaging forces to the weakest part of chess clocks, the operational connections between the switching mechanisms and the electronics of the two clocks. Switching mechanism 52 is physically connected with the physical electronic components via the housing and their mounts, but this connection cannot effect an operational functioning of the clock circuitry, as the word is understood in the disclosure and claims herein. Thus, an extremely durable chess clock can be inexpensively manufactured and sold.

Referring to FIG. 2 and the time selector circuitry shown in block diagram form at the bottom of FIG. 6, time/move selector circuitry 230, which can be any of the standard alarm/time setting mechanisms of ordinary digital clocks or watches, has the normal time controls of forty moves in two hours and twenty moves in one hour permanently stored in its memory, as mentioned before. When chess clock 10 is turned on, two hours, zero minutes, zero seconds and forty moves are displayed by default in time selector display 56 and move selector display 58, respectively, as shown in FIG. 2. Should this be the time/move limits agreed upon for play, depression of set button 74 opens AND gate 232 to input the information into each clock. Should, however, another time/move pair be desired, selector buttons 60 in coordination with control buttons 62 input the desired changes into time selector display 56 and move selector display 58. When the appropriate time and move limits are displayed in the time/move displays 56, 58, set button 74 is depressed to enter the selected limits into clocks 26 and 28.

Depression once of time control button 59 transfers the second time control of one hour/twenty moves, which is also permanently stored in time/move selector 230, to time display 56 and move display 58, respectively. If it is the agreed-upon second time control, it is entered into clocks 26 and 28 by depressing set button 74; if it is not, selector buttons 60 and control buttons 62 are again used to select the proper time/move limits for the second time control.

Completing the description of FIG. 6, chess clock 10 includes means to announce the end of the game due to a time violation by either player. This is broadly shown in FIG. 6 and more specifically in FIG. 7. In FIG. 6, when either clock runs out of time prior to its player making the required number of moves, a logical ONE is sent to OR gate 234 and therethrough to a circuit for turning on game-over red light 40 and, if desired, a game-over buzzer, not shown. Red light 40 can either glow steadily or flash, as desired. OR gate 234 is used primarily to isolate the two clocks from each other to avoid any possibility of cross-talk.

Turning now to FIG. 7, a block diagram of the circuitry of white's clocks is shown; black's clock is identical. The time/move limits selected as above described are input by set button 74 from time/move selector 230 via AND 232. The first time/move limit displayed in time/move displays 56 and 58, whether the default pair permanently stored in time/move selector 230 or one selected by the user of chess clock 10, is input into a first time/move limit memory 236. Time control button 59 is depressed (FIG. 6) and the second time/move pair is input into a second time/move limit memory 238, button 59 activating known circuitry for by-passing first time/move limit memory 236. Solely for purposes of description, the time limits are assumed to be two hours for forty moves and one hour for twenty moves, respectively.

The first time control is automatically stored in clock counter memory 240 and instantaneously displayed in clock display 30. Time limit comparator 242 receives the time currently registered in clock counter memory 240 and compares it to zero. So long as said current time is greater than zero, both outputs of comparator 242 are logical ZEROs. NOR unit 244 changes this input signal to ONE which enables AND gate 246, allowing timing pulses 248 from timing pulse generator 202 to pass through to clock counter memory 240, when timing AND gate 208 is open. Clock counter memory 240 responds to timing pulses 248 by counting down toward zero. White's clock display 30 continuously shows the time currently in clock counter memory 240.

Should the time in clock counter memory 240 reach zero, time limit comparator 242 will note the event and output logical ONEs simultaneously to NOR unit 244 and OR unit 234. NOR unit 244 changes the ONE to a ZERO which closes AND gate 246, shutting off clock counter memory 240. White's clock display 30 displays zero hours, zero minutes, and zero seconds, showing that it was white's clock that ran out of time. Simultaneously, the ONE output from time limit comparator 242 directed to OR unit 234 activates red light 40 (and/or a buzzer) to signal the end of the game. The input to OR unit 234 from black's clock, to signify black's time has run out, is illustrated by the circle-BC in FIG. 7.

Turn now to the move counting circuitry of FIG. 7. Upon turning on chess clock 10 by switch 38, initializer 228 sends a signal, over the line designated circle-A in FIGS. 6 and 7 to flip-flop 252, which sets it to ONE, and to move memory counter 254 to set it to zero. When the time controls are entered into the two time/move limit memories 236 and 238, the first move limit, assumed for the time being to be forty, is input into the move limit comparator 250. The move counting circuitry is now ready to begin the game. Each time reflected beam 98 sweeps upwardly past white's sensor 100, a pulse is generated, shaped by pulse shaper 212, and sent (circle-PS in FIG. 7) to flip-flop 252, switching it to ZERO; this does not affect move counter memory 254. The downswing of reflected beam 98 past sensor 100 generates another pulse which switches flip-flop 252 back to ONE. Each time flip-flop 252 is reset to ONE, move counter memory 254 responds by counting up one move. Thus, a count signal is sent to move counter memory 254, when white turns off his clock, i.e., at the end of his or her move. This is consistent with the usual operations of prior art mechanical and electronic clocks. The current status of move counter memory 254 is shown in white's move display 32. The move displayed is the number of moves each player has already made, not the number remaining of the required time control move limit.

Move limit comparator 250 subtracts the move currently in move counter memory 254 from the move limit initially set therein by first time/move limit memory 236, i.e., forty. For example, the clock shown in FIG. 1 indicates that white has made thirty-two moves. Move limit comparator 250 automatically subtracts thirty-two from forty to give the result of eight. When the result of the subtraction is zero, a signal is sent to second time/move limit memory 238, which responds by adding the second move limit to the move limit stored in move limit comparator 250 (increasing the forty therein by twenty to sixty, in our assumed situation); this action-reaction communication between move limit comparator 250 and second time/move limit memory 238 is indicated by the double-ended arrow connecting them. The moves displayed in move display 32 is still forty, and will continue to climb with each subsequent move, but it is now subtracted from the larger internal number stored in move limit comparator 250. Second time/move limit memory 238 also responds to the signal from move limit comparator 250 by adding the second time limit to the time currently present in clock counter memory 240. Thus, one hour is added to however much time white has left in clock counter memory 240, as displayed on clock display 30.

The process is repeated every time the subtraction in move limit comparator 250 equals zero: the second move limit is added to move limit comparator 250 and the second time limit is added to the time in clock counter memory 240. Thus, clock 10 continuously shows a positive time as remaining and continues to count the moves already made until the game is over due to the play on the board, i.e., a draw is declared, one player resigns, or one player has checkmated the other.

It is clear from the above that the objects of the invention have been fulfilled. A chess clock has been disclosed which is economical to produce, due to its employment of standard units in its electronic circuitry, and especially durable, due to the switching mechanism being operationally connected to the electronics of the clock optically instead of mechanically or electrically.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It is further to be understood that the disclosure is by way of illustration only and that the scope of the invention is to be limited solely by the following claims:

I claim as my invention:

1. A chess clock, comprising:

a housing;

a pair of clock means, one for each player of a chess game, for measuring the elapsed time and displaying the time remaining for each said player and for counting and displaying the number of moves made by each said player;

pulse generating means for providing a train of timing pulses to said pair of clock means for counting down said time remaining;

display means on said housing for displaying the time remaining and the number of moves made for each said player;

circuit means for directing said pulse train alternately and mutually exclusively to each of said clock means and for providing counting pulses to each of said clock means to count said number of moves; and switching means for activating said circuit means to operatively switch between each of said clock means, said switching means having no mechanical or electrical operational connection with said circuit means.

2. A chess clock as in claim 1, wherein said switching means is operationally connected with said circuit means by electromagnetic means.

3. A chess clock as in claim 2, wherein said electromagnetic means comprises optical means.

4. A chess clock as in claim 3, wherein said switching means comprises a rocker arm, said rocker arm comprising a unitary structure including a pair of pedestals integrally formed at opposite ends of a cross-piece, said rocker arm being mounted on said housing for pivotal movement between two extreme positions, and said rocker arm including a reflective surface;

said optical means comprises an optical emitter fixed within said housing for emitting a radiant beam, said radiant beam being directed toward said reflective surface, said radiant beam being reflected from said reflective surface as a reflected beam, the direction of reflection of said reflected beam being dependent on the angular position of said rocker arm; and said circuit means includes a pair of optical sensors positioned respectively on opposite sides of and spaced from said optical emitter such that when said rocker arm is rotated from one of said extreme positions to the other of said extreme positions, said reflected beam will sweep over said pair of sensors sequentially causing each of said sensors to generate an electrical pulse which constitutes an input signal to said circuit means.

5. A chess clock as in claim 4, wherein said optical means comprises infrared means, said emitter is an infrared emitter, said radiant beam and said reflected beam are infrared beams, and said optical sensors are infrared sensors.

6. A chess clock as in claim 4, wherein said circuit means includes a pair of substantially identical circuits;

each of said identical circuits comprising:

a sensor for providing a sensor signal each time said reflected beam sweeps over said sensor;

a pulse shaper connected to said sensor for generating a shaped signal in response to each said sensor signal;

a FLIP-FLOP responsive to sequential ones of said shaped signals to provide output signals which alternate in logical state;

a NOR unit responsive to said output signals of said FLIP-FLOP to change its state;

a steering AND gate having one input from said NOR unit; and a timing AND gate having one input from said steering AND gate and an output to one of said player's clock means; and the output signal from said FLIP-FLOPS of each of said identical circuits also providing the second input of said steering AND gates of the other of said identical circuits, and said pulse generating means providing the second input to said timing AND gates of both of said identical circuits, whereby in response to sequential sensor pulses generated by a respective one of said sensors, alternate sensor pulses will turn on and turn off the associated clock means.

7. A chess clock as in claim 6, wherein said pulse shaper generates a second shaped signal in response to each said sensor signal, said second shaped signals comprising said counting pulses.

8. A chess clock as in claim 4, wherein said housing includes a top with a pair of apertures therethrough; and said rocker arm pivots about an axis parallel to said housing top with each of said pedestals of said rocker arm protruding through a respective one of said pair of apertures.

9. A chess clock as in claim 8, wherein said housing top has a top surface and a bottom surface;

each of said pedestals include a flat top surface; and said cross-piece is pivotally mounted below said housing top such that when said rocker arm is in one of said extreme positions, one of said pedestal top surfaces is flush with said housing top surface and the other of said pedestal top surfaces extends substantially above said housing top surface, and when said rocker arm is in the other of said extreme positions, the other of said pedestal top surfaces is flush with said housing top surface and the said one of said pedestal top surfaces extends substantially above said housing top surface, and when said rocker arm is in-between said extreme positions, both of said pedestal top surfaces extend noticably above said housing top surface.

10. A chess clock as in claim 9, wherein the upper surface of said cross-piece includes two stop surfaces which slope downwardly from a point above said axis; and said rocker arm being pivotally mounted such that alternate ones of said stop surfaces are in contact with said bottom surface of said housing when said rocker arm is in alternate ones of said extreme positions.

11. A chess clock as in claim 10, wherein the width of said rocker arm is substantially the same from end to end; and said rocker arm width is over half the width of said housing top.

12. A chess clock as in claim 10, wherein cushioning means are provided for cushioning the contact between said housing bottom surface and said stop surfaces.

13. A chess clock as in claim 1, wherein said each of said clock means is a digital clock.

14. A chess clock as in claim 1 wherein said switching means is operationally connected with said circuit means by a radiant beam.

* * * * *